US012139772B2

(12) United States Patent
Abukawa et al.

(10) Patent No.: US 12,139,772 B2
(45) Date of Patent: Nov. 12, 2024

(54) HIGH STRENGTH STEEL SHEET

(71) Applicant: NIPPON STEEL CORPORATION, Tokyo (JP)

(72) Inventors: Genki Abukawa, Tokyo (JP); Hiroshi Shuto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 598 days.

(21) Appl. No.: 17/603,726

(22) PCT Filed: Jul. 8, 2020

(86) PCT No.: PCT/JP2020/026717
§ 371 (c)(1),
(2) Date: Oct. 14, 2021

(87) PCT Pub. No.: WO2021/006298
PCT Pub. Date: Jan. 14, 2021

(65) Prior Publication Data

US 2022/0195554 A1 Jun. 23, 2022

(30) Foreign Application Priority Data

Jul. 10, 2019 (JP) ..... 2019-128590

(51) Int. Cl.
*C21D 9/46* (2006.01)
*C22C 38/00* (2006.01)
(Continued)

(52) U.S. Cl.
CPC ..... *C21D 9/46* (2013.01); *C22C 38/001* (2013.01); *C22C 38/002* (2013.01); *C22C 38/02* (2013.01);
(Continued)

(58) Field of Classification Search
CPC ..... C21D 2211/002; C21D 2211/008; C22C 38/02; C22C 38/04; C22C 38/06; C22C 38/002; C22C 38/26; C22C 38/28
See application file for complete search history.

(56) References Cited

U.S. PATENT DOCUMENTS 6,364,968 B1 4/2002 Yasuhara et al.
2012/0031528 A1 2/2012 Hayashi et al.
(Continued)

FOREIGN PATENT DOCUMENTS

CN 107429362 A 12/2017
JP 2013-100574 A 5/2013
(Continued)

*Primary Examiner* — Anthony M Liang
*Assistant Examiner* — Jacob J Gusewelle
(74) *Attorney, Agent, or Firm* — Birch, Stewart, Kolasch & Birch, LLP

(57) ABSTRACT

A high strength steel sheet according to the present invention contains a predetermined chemical composition, in a metallographic structure, the total area ratio of tempered martensite and bainite is 80% or more, at a sheet thickness ¼ position of a cross section parallel to a rolling direction and perpendicular to a rolled surface, the standard deviation of number densities of precipitates having a diameter of 10 nm or less and including one or both of Ti and Nb is less than $5\times10^{10}$ numbers/mm$^3$, and the tensile strength is 780 MPa or more.

8 Claims, 1 Drawing Sheet

(51) Int. Cl.
*C22C 38/02* (2006.01)
*C22C 38/04* (2006.01)
*C22C 38/06* (2006.01)

(52) U.S. Cl.
CPC ..... *C22C 38/04* (2013.01); *C22C 38/06* (2013.01); *C21D 2211/002* (2013.01); *C21D 2211/008* (2013.01)

(56) References Cited

U.S. PATENT DOCUMENTS

2014/0295210 A1 10/2014 Ariga et al.
2018/0119240 A1* 5/2018 Tanaka ..... C21D 6/02

FOREIGN PATENT DOCUMENTS

JP 2017-150052 A 8/2017
WO WO 2010/137317 A1 12/2010

* cited by examiner

HIGH STRENGTH STEEL SHEET

TECHNICAL FIELD OF THE INVENTION

The present invention relates to a high strength steel sheet having excellent tensile strength, total elongation, and bendability, and being excellent in terms of material quality stability.

Priority is claimed on Japanese Patent Application No. 2019-128590, filed in Japan on Jul. 10, 2019, the content of which is incorporated herein by reference.

RELATED ART

So-called hot-rolled steel sheet manufactured by hot rolling is widely used as a relatively inexpensive structural material, and as a material for structural elements of vehicles or industrial equipment. Specifically, strengthening of the hot-rolled steel sheet, which is used in suspension parts, bumper parts, or impact absorption parts of the vehicles, progresses, while excellent workability, by which the hot-rolled steel sheet can resist forming to a complex shape, is required for the hot-rolled steel sheet.

Thus far, low strength steel sheets have had a relatively simple structure configuration in which a ferrite structure is the main component and the strength is secured with a small amount of solid solution strengthening element as necessary, whereas, in high strength steel, a low-temperature transformation structure such as bainite or martensite or a precipitate such as TiC is used to secure the strength, and thus, the structure configuration of the high strength steel becomes complex. These phenomena of transformation, precipitation, or the like are significantly affected by the temperature history, and, in a manufacturing step of a hot-rolled steel sheet, there is a possibility that the temperature history may vary in the width direction and the longitudinal direction due to unevenness in the method of applying cooling water in the width direction, unevenness in the cooling rate depending on positions in a coil after coiling, or the like. It is important in the high strength hot-rolled steel sheets to suppress destabilization of formability (unevenness of mechanical properties in a width direction or a longitudinal direction of a coil) due to above-described unevenness of temperature.

Patent Document 1 reports a technique in which both of high strength and excellent formability are obtained by skin pass rolling a hot-rolled steel sheet, and heating the hot-rolled steel sheet in a temperature range of 600 to 750° C. to precipitate fine carbides.

Incidentally, regarding material quality stability, Patent Document 2 reports a technique in which, in a hot-rolled steel sheet having a tensile strength of 780 MPa or more, the amount of Ti and V added is controlled to be within a certain range, whereby fine carbides are uniformly precipitated during hot rolling and coiling and, consequently, the material quality of the hot-rolled steel sheet is stabilized.

PRIOR ART DOCUMENT

Patent Document

[Patent Document 1] International Publication No. WO2010/137317

[Patent Document 2] Japanese Unexamined Patent Application, First Publication No. 2013-100574

DISCLOSURE OF THE INVENTION

Problems to be Solved by the Invention

However, the present inventors found that the prior art cannot obtain sufficient material quality stability. An object of the present invention is to provide a high strength hot-rolled steel sheet having excellent tensile strength, total elongation, and bendability and being excellent in terms of material quality stability. The material quality stability means that the variation in tensile strength and total elongation is small in each portion in a steel sheet.

Means for Solving the Problem (1) A high strength steel sheet according to one aspect of the present invention contains, as a chemical composition, by mass %, C: 0.030% to 0.280%, Si: 0.05% to 2.50%, Mn: 1.00% to 4.00%, sol. Al: 0.001% to 2.000%, P: 0.100% or less, S: 0.0200% or less, N: 0.01000% or less, O: 0.0100% or less, Ti: 0% to 0.20%, Nb: 0% to 0.20%, total of Ti and Nb: 0.04% to 0.40%; B: 0% to 0.010%; V: 0% to 1.000%, Cr: 0% to 1.000%, Mo: 0% to 1.000%, Cu: 0% to 1.000%, Co: 0% to 1.000%, W: 0% to 1.000%, Ni: 0% to 1.000%, Ca: 0% to 0.0100%, Mg: 0% to 0.0100%, REM: 0% to 0.0100%, Zr: 0% to 0.0100%, and a remainder including Fe and impurities, in which, in a metallographic structure, a total area ratio of tempered martensite and bainite is 80% or more, at a sheet thickness ¼ position of a cross section parallel to a rolling direction and perpendicular to a rolled surface, a standard deviation of number densities of precipitates having a diameter of 10 nm or less and including one or both of Ti and Nb is less than $5\times10^{10}$ numbers/mm$^3$, in which the number densities are measured at 10 points every 50 mm in a width direction, and the tensile strength is 780 MPa or more.

(2) In the high strength steel sheet according to (1), the standard deviation of surface roughnesses Ra may be 1.0 μm or less, in which the surface roughnesses Ra are measured in 10 positions at intervals of 50 mm along the width direction.

(3) The high strength steel sheet according to (1) or (2) may contain, as the chemical composition, by mass %, at least one from the group consisting of B: 0.001% to 0.010%, V: 0.005% to 1.000%, Cr: 0.005% to 1.000%, Mo: 0.005% to 1.000%, Cu: 0.005% to 1.000%, Co: 0.005% to 1.000%, W: 0.005% to 1.000%, Ni: 0.005% to 1.000%, Ca: 0.0003% to 0.0100%, Mg: 0.0003% to 0.0100%, REM: 0.0003% to 0.0100%, and Zr: 0.0003% to 0.0100%.

(4) In the high strength steel sheet according to any one of (1) to (3), the total elongation may be 10% or more, and R/t, which is a value calculated by dividing the limit bend radius by the thickness, may be 2.0 or less.

Effects of the Invention

According to the above-described aspect, it is possible to obtain a high strength steel sheet having excellent tensile strength, total elongation, and bendability and being excellent in terms of material quality stability.

EMBODIMENTS OF THE INVENTION

Figure 1:
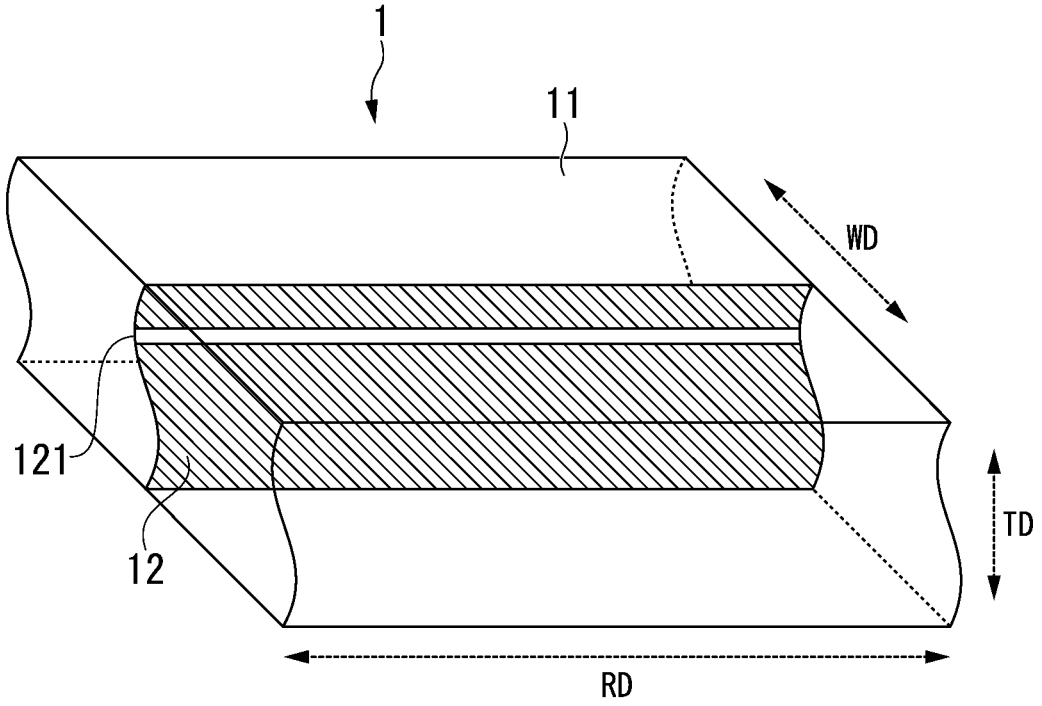
FIG. 1 is a conceptual diagram showing an observed section for evaluating a metallographic structure.

The present inventors searched a method for stabilizing material quality in a high strength steel sheet. A hot-rolled steel sheet is coiled after hot rolling to be a coil shape, and the cooling rate of the hot-rolled steel sheet after coiling may vary according to the position in the coil. Due to the variation of the cooling rate, the volume ratio of a transformation structure, the number density of precipitates, or the like may vary extremely according to the position in the coil. The present inventors found that such phenomenon may cause instability of the material quality.

On the other hand, when the hot-rolled steel sheet is cooled to relatively low temperature (500° C. or lower) in the cooling zone after finish rolling of the hot rolling, and then coiled, the overall structure of the hot-rolled steel sheet becomes a low-temperature transformation structure (such as bainite, martensite, or the like), and precipitates of substitutional elements (Ti, Nb), which contribute strength, do not much precipitate. The present inventors found that, in this case, unevenness of the volume ratio of the transformation structure and unevenness of the number density of the precipitates hardly occur, and thus, the material quality can be stabilized. However, the structure obtained by the above-described method is mainly configured from the low-temperature transformation structure having low work hardenability. Therefore, the total elongation of the steel sheet obtained by the above-described method may be a relatively low level such as less than 10%, or 9% or less. In order to extend the kind of parts on which the steel is applicable, it is desirable to further enhance the formability.

The present inventors made an attempt to temper the hot-rolled steel sheet, which was coiled at above-described low temperature, at a temperature of 500° C. or more. Consequently, dislocation introduced during transformation was recovered, and the hot-rolled steel sheet had an excellent property in which the total elongation was 10% or more. However, tempering the low-temperature transformation structure decreases strength. Therefore, the present inventors caused precipitation hardening in the steel sheet by alloy elements such as Ti and Nb included in the steel sheet, which precipitate in 550° C. or more, and enhanced both of the total elongation and strength.

However, it was found that, when the surface of the hot-rolled steel sheet before tempering has unevenness of roughness due to unevenness of descaling of scale during finish rolling, the unevenness of roughness causes unevenness in emissivity during temperature rising for the tempering, and the heating temperature may vary according to the position. Such unevenness of the temperature causes unevenness of the precipitation density, and consequently, causes instability of material quality.

Therefore, the present inventors further repeated intensive studies, and invented a method which can reduce surface roughness of the hot-rolled steel sheet before tempering by properly controlling the temperature during hot rolling, steel sheet component, and method of descaling, and reduce the unevenness of temperature caused by the surface roughness during tempering to obtain a high strength steel sheet being excellent in terms of material quality stability.

Hereinafter, a high strength steel sheet according to one embodiment of the present invention will be described in detail. Here, the present invention is not limited only to a constitution disclosed in the present embodiment and can be modified in a variety of manners within the scope of the gist of the present invention. In addition, numerical limiting ranges described below includes the lower limits and the upper limits in the ranges. Numerical values expressed with 'more than' or 'less than' are not included in the numerical ranges. "%" regarding the amount of each element means "mass %".

Figure 2:
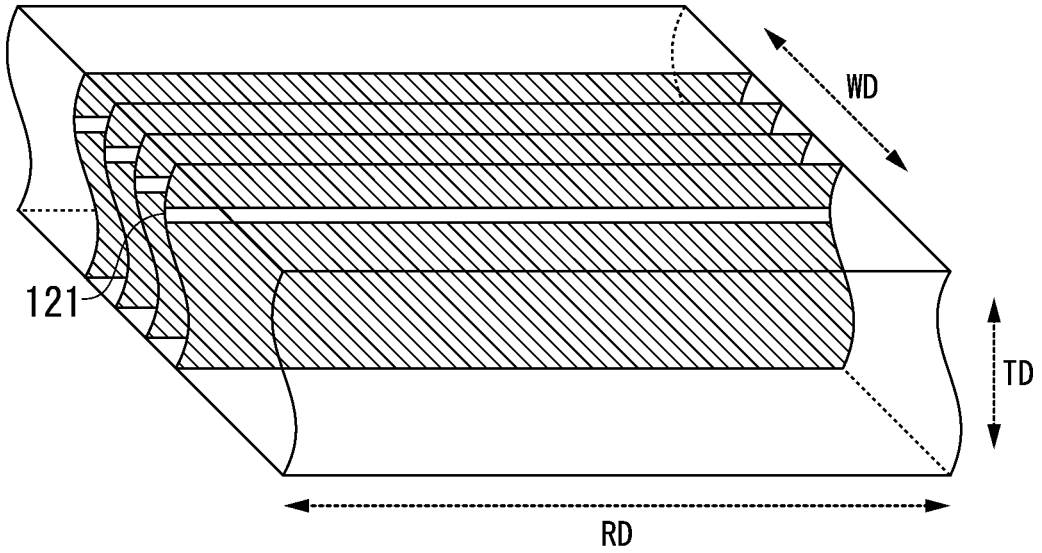
FIG. 2 is a conceptual diagram showing an observed section for evaluating the standard deviation of the number densities of precipitates.

In a high strength steel sheet 1 according to the present embodiment, a rolling direction RD, a thickness direction TD, and a width direction WD shown in FIG. 1 and FIG. 2 are defined as described below. The rolling direction RD means a direction in which the steel sheet is moved by a rolling roll during rolling. The thickness direction TD is a direction perpendicular to a rolled surface 11 of the steel sheet. The width direction WD is a direction perpendicular to the rolling direction RD and the thickness direction TD. The rolling direction RD can be easily specified based on the stretching direction of the crystal grain of the steel sheet. Therefore, the rolling direction RD can be specified even for a steel sheet cut out from a rolled material steel sheet.

In the high strength steel sheet according to the present embodiment, the total area ratio of tempered martensite and bainite are regulated. The area ratio of the metallographic structure is measured in a cross section 12 parallel to the rolling direction RD and perpendicular to the rolled surface 11 (refer to FIG. 1). Hereinafter, there will be cases where the cross section 12 parallel to the rolling direction RD and perpendicular to the rolled surface 11 is simply referred to as the cross section parallel to the rolling direction RD. A detailed method for evaluating the metallographic structure will be described below.

In the high strength steel sheet according to the present embodiment, the standard deviation of number densities of precipitates (precipitates including Ti/Nb) having a diameter of 10 nm or less and including one or both of Ti and Nb is regulated. The number density of precipitates including Ti/Nb is measured at a sheet thickness ¼ position 121 of the cross section 12 parallel to the rolling direction RD and perpendicular to the rolled surface 11 (refer to FIG. 2). Ten cross sections 12 parallel to the rolling direction RD and perpendicular to the rolled surface 11 are produced every 50 mm along the width direction WD, and the standard deviation of the 10 number densities measured on these surfaces is regarded as the standard deviation of the number densities of precipitates including Ti/Nb according to the present embodiment.

The sheet thickness ¼ position is a position at a depth of ¼ of the thickness of the steel sheet 1 from the rolled surface 11 of the steel sheet 1. In FIG. 1 and FIG. 2, only the position at a depth of ¼ of the thickness of the steel sheet 1 from the upper rolled surface 11 of the steel sheet 1 is shown as the sheet thickness ¼ position. However, it is needless to say that the position at a depth of ¼ of the thickness of the steel sheet 1 from the lower rolled surface 11 of the steel sheet 1 can also be treated as the sheet thickness ¼ position. In addition, FIG. 2 shows only some of the 10 measurement surfaces for number density. Furthermore, FIG. 2 merely conceptually shows the measurement points of the number densities, and there is no need to form the number density measurement surfaces as shown in FIG. 2 as long as a predetermined requirement is satisfied. A detailed method for evaluating the standard deviation of the number densities of precipitates including Nb/Ti will be described below.

[High Strength Steel Sheet]

The high strength steel sheet according to the present embodiment contains, as a chemical composition, by mass %, C: 0.030% to 0.280%,
Si: 0.05% to 2.50%,
Mn: 1.00% to 4.00%,
sol. Al: 0.001% to 2.000%,
P: 0.100% or less,
S: 0.0200% or less,
N: 0.01000% or less,
O: 0.0100% or less,
Ti: 0% to 0.20%,
Nb: 0% to 0.20%,
total of Ti and Nb: 0.04% to 0.40%;
B: 0% to 0.010%,
V: 0% to 1.000%,
Cr: 0% to 1.000%,
Mo: 0% to 1.000%,
Cu: 0% to 1.000%,
Co: 0% to 1.000%,
W: 0% to 1.000%,
Ni: 0% to 1.000%,
Ca: 0% to 0.0100%,
Mg: 0% to 0.0100%,
REM: 0% to 0.0100%,
Zr: 0% to 0.0100%, and
remainder: Fe and impurities, in a metallographic structure, a total area ratio of tempered martensite and bainite is 80% or more, at a sheet thickness ¼ position of a cross section parallel to a rolling direction and perpendicular to a rolled surface, a standard deviation of number densities of precipitates having a diameter of 10 nm or less and including one or both of Ti and Nb is less than $5\times10^{10}$ numbers/mm$^3$, in which the number densities are measured at 10 points every 50 mm in a width direction, and a tensile strength is 780 MPa or more.

1. Chemical Composition

Hereinafter, the composition of the high strength steel sheet according to the present embodiment will be described in detail. The high strength steel sheet according to the present embodiment contains, as a chemical composition, basic elements and an optional element as necessary, and the remainder includes Fe and impurities.

(C: 0.030% or More and 0.280% or Less)

C is an important element for ensuring the strength of the steel sheet. When the C content is less than 0.030%, it is not possible to ensure a tensile strength of 780 MPa or more. Therefore, the C content is set to 0.030% or more, preferably 0.050% or more, 0.100% or more, or 0.120% or more.

On the other hand, when the C content becomes more than 0.280%, since the weldability becomes poor, the upper limit is set to 0.280%. The C content is preferably 0.250% or less, or 0.200% or less, and more preferably 0.150% or less, 0.140% or less, 0.130% or less, or 0.120% or less.

(Si: 0.05% or More and 2.50% or Less)

Si is an important element which can enhance material strength by solid solution strengthening. When the Si content is less than 0.05%, yield strength deteriorates, and thus, the Si content is set to 0.05% or more. The Si content is preferably 0.10% or more, and more preferably 0.30% or more, 1.00% or more, or 1.20% or more.

On the other hand, when the Si content is more than 2.50%, since the deterioration of the surface properties is caused, the Si content is set to 2.50% or less. The Si content is preferably 2.00% or less, more preferably 1.80% or less, 1.50% or less, or 1.30% or less.

(Mn: 1.00% or More and 4.00% or Less)

Mn is an effective element for increasing the mechanical strength of the steel sheet. When the Mn content is less than 1.00%, it is not possible to ensure a tensile strength of 780 MPa or more. Therefore, the Mn content is set to 1.00% or more. The Mn content is preferably 1.50% or more and more preferably 1.80% or more, 2.00% or more, or 2.20% or more.

On the other hand, when an excess of Mn is added, the structure becomes uneven due to the segregation of Mn, and the bending workability deteriorates. Therefore, the Mn content is set to 4.00% or less, preferably 3.00% or less, more preferably 2.80% or less, 2.60% or less, or 2.50% or less.

(Sol. Al: 0.001% or More and 2.000% or Less)

Al is an element having an action of deoxidizing steel to make the steel sheet sound. When the sol. Al content is less than 0.001%, since sufficient deoxidation is not possible, the sol. Al content is set to 0.001% or more. However, in a case where sufficient deoxidation is required, 0.010% or more of sol. Al is desirably added. The sol. Al content is more desirably 0.020% or more, 0.030% or more, or 0.050% or more.

On the other hand, when the sol. Al content is more than 2.000%, the degradation of the weldability becomes significant, and the number of oxide-based inclusions increases, which significantly degrades the surface properties. Therefore, the sol. Al content is set to 2.000% or less and is preferably 1.500% or less, more preferably 1.000% or less, and most preferably 0.090% or less, 0.080% or less, or 0.070% or less. Sol. Al means acid-soluble Al that does not turn into an oxide such as $Al_2O_3$ and is soluble in acids.

(Total of Ti and Nb: 0.04% to 0.40%)

In the present invention, Ti and Nb are important elements, since Ti and Nb contribute to the strength as precipitates at tempering hot-rolled steel sheet. In order to obtain the effect, 0.04% or more in total of Ti and Nb are needed. When Ti and Nb are less than 0.04% in total, sufficient strength cannot be obtained. Ti and Nb are preferably 0.08% or more, and more preferably 0.10% or more, 0.12% or more, or 0.15% or more in total. On the other hand, when Ti and Nb are excessively added, recrystallization during hot rolling is suppressed and texture having specific crystal orientation grows so that hole expansibility, which is one of index of formability of steel sheet for vehicle, deteriorates. Accordingly, it is necessary that Ti and Nb are 0.40% or less in total. Ti and Nb are preferably 0.35% or less, and more preferably 0.32% or less, 0.30% or less, or 0.25% or less in total.

(Ti: 0.20% or Less)

As described above, when Ti is excessively added, recrystallization during hot rolling is suppressed and texture having specific crystal orientation grows so that hole expansibility, which is one of index of formability of steel sheet for vehicle, deteriorates. Accordingly, it is necessary that the Ti content is 0.20% or less. The Ti content may be 0.18% or less, 0.15% or less, or 0.10% or less. The lower limit of Ti content is not individually limited, and is defined in view of above-described total content of Ti and Nb. Therefore, the Ti content may be 0%. On the other hand, the Ti content may be defined as 0.01% or more, 0.02% or more, or 0.05% or more.

(Nb: 0.20% or Less)

As described above, when Nb is excessively added, recrystallization during hot rolling is suppressed and texture having specific crystal orientation grows so that hole expansibility, which is one of index of formability of steel sheet for vehicle, deteriorates. Accordingly, it is necessary that the Nb content is 0.20% or less. The Nb content may be 0.18% or less, 0.15% or less, or 0.10% or less. The lower limit of Nb content is not individually limited, and is defined in view of above-described total content of Ti and Nb. Therefore, the Nb content may be 0%. On the other hand, the Nb content may be defined as 0.01% or more, 0.02% or more, or 0.05% or more.

The high strength steel sheet according to the present embodiment contains, as the chemical composition, impurities. The "impurities" refer to, for example, elements that are contained by accident from ore or scrap that is a raw material or from the manufacturing environments or the like at the time of industrially manufacturing steel. The impurities mean, for example, elements such as P, S, and N. These impurities are preferably limited as described below in order to make the effect of the present embodiment sufficiently exhibited. In addition, since the amount of the impurities is preferably small, it is not necessary to limit the lower limit, and the lower limit of impurities may be 0%.

(P: 0.100% or Less)

P is ordinarily an impurity that is contained in steel, but has an action of increasing the tensile strength, and thus P may be positively contained. However, when the P content is more than 0.100%, the deterioration of the weldability becomes significant. Therefore, the P content is limited to 0.100% or less. The P content is preferably limited to 0.080% or less, 0.070% or less, or 0.050% or less.

Although the lower limit of the P content is not particularly limited, in order to more reliably obtain the effect of the above-described action, the P content may be set to 0.001% or more, 0.002% or more, or 0.005% or more.

(S: 0.0200% or Less)

S is an impurity that is contained in steel, and the S content is preferably as low as possible from the viewpoint of weldability. When the S content is more than 0.0200%, the weldability significantly deteriorates, the amount of MnS precipitated increases, and the low temperature toughness deteriorates. Therefore, the S content is limited to 0.0200% or less. The S content is preferably 0.0100% or less and more preferably limited to 0.0080% or less, 0.0070% or less, or 0.0050% or less.

Although the lower limit of S content is not particularly limited, from the viewpoint of the desulfurization cost, the S content may be set to 0.0010% or more, 0.0015% or more, or 0.0020% or more.

(N: 0.01000% or Less)

N is an impurity that is contained in steel, and the N content is preferably as low as possible from the viewpoint of weldability. When the N content is more than 0.01000%, the degradation of the weldability becomes significant. Therefore, the N content is limited to 0.01000% or less and may be preferably 0.00900% or less, 0.00700% or less, or 0.00500% or less. The lower limit of the N content is not particularly limited, but the N content may be set to, for example, 0.00005% or more, 0.00010% or more, or 0.00020% or more.

(O: 0.0100% or Less)

O is an impurity that is contained in steel, and the O content is preferably as low as possible from the viewpoint of the weldability. When the O content is more than 0.0100%, the degradation of weldability becomes significant. Therefore, the O content is limited to 0.0100% or less and is preferably 0.0090% or less, 0.0070% or less, or 0.0050% or less. The lower limit of the O content is not particularly limited, but the O content may be set to, for example, 0.0005% or more, 0.0008% or more, or 0.0010% or more.

The high strength steel sheet according to the present embodiment may contain an optional element in addition to the basic elements and the impurities described above. For example, instead of some of Fe that is the remainder described above, B, V, Cr, Mo, Cu, Co, W, Ni, Ca, Mg, REM, and Zr may be contained as optional elements. These optional elements may be contained according to the purpose. Therefore, it is not necessary to limit the lower limits of these optional elements, and the lower limits may be 0%. In addition, even when these optional elements are contained as impurities, the above-described effects are not impaired.

(B: 0% or More and 0.010% or Less)

B can suppress the roughness of punched cross section in punching by segregating in the grain boundary and enhancing grain boundary strength. Therefore, B may be included. When the B content is more than 0.010%, the above-described effect saturates, which is economically disadvantageous, and thus, the B content is 0.010% or less. The B content is preferably 0.005% or less, and more preferably 0.003% or less. In order to preferably obtain the above-described effect, the B content may be 0.001% or more.

(V: 0% or more and 1.000% or less)
(Cr: 0% or more and 1.000% or less)
(Mo: 0% or more and 1.000% or less)
(Cu: 0% or more and 1.000% or less)
(Co: 0% or more and 1.000% or less)
(W: 0% or more and 1.000% or less)
(Ni: 0% or more and 1.000% or less)

V, Cr, Mo, Cu, Co, W, and Ni are all effective elements for stably ensuring the strength. Therefore, these elements may be contained. However, even when more than 1.000% of each of the elements are contained, the effect of the above-described action is likely to be saturated, and there are cases where containing such elements becomes economically disadvantageous. Therefore, it is preferable that each of the V content, Cr content, Mo content, Cu content, Co content, W content, and Ni content are set to 1.0% or less or 1.000% or less. The upper limit of each of the V content, Cr content, Mo content, Cu content, Co content, W content, and Ni content may be set to 0.500% or less, 0.300% or less, or 0.100% or less.

In order to more reliably obtain the effect of the above-described action, at least one of V: 0.005% or more, 0.008% or more, or 0.010% or more,
Cr: 0.005% or more, 0.008% or more, or 0.010% or more,
Mo: 0.005% or more, 0.008% or more, or 0.010% or more,
Cu: 0.005% or more, 0.008% or more, or 0.010% or more,
Co: 0.005% or more, 0.008% or more, or 0.010% or more,
W: 0.005% or more, 0.008% or more, or 0.010% or more, and
Ni: 0.005% or more, 0.008% or more, or 0.010% or more is preferably contained.

(Ca: 0% or more and 0.0100% or less)
(Mg: 0% or more and 0.0100% or less)
(REM: 0% or more and 0.0100% or less)
(Zr: 0% or more and 0.0100% or less)

Ca, Mg, REM, and Zr are all elements that contribute to the control of an inclusion, particularly, the fine dispersion of an inclusion and have an action of enhancing toughness. Therefore, one or more of these elements may be contained. However, when the amount is more than 0.0100% for any of the elements, there are cases where the deterioration of surface properties is actualized. Therefore, the amount of each element is preferably set to 0.01% or less or 0.0100% or less. The upper limit of the amount of each of Ca, Mg, REM, and Zr may be set to 0.0080%, 0.0050%, or 0.0030%. In order to more reliably obtain the effect of the above-described action, the amount of at least one of these elements is preferably set to 0.0003% or more, 0.0005% or more, or 0.0010% or more.

Here, REM refers to a total of 17 elements of Sc, Y and lanthanoids and is at least one of them. The REM content means the total amount of at least one of these elements. Industrially, lanthanoids are added in a mischmetal form.

The high strength steel sheet according to the present embodiment preferably contains, as the chemical composition, by mass %, at least one of Ca: 0.0003% or more and 0.0100% or less, Mg: 0.0003% or more and 0.0100% or less, REM: 0.0003% or more and 0.0100% or less, and Zr: 0.0003% or more and 0.0100% or less.

The above-described steel composition may be measured by an ordinary analysis method of steel. For example, the steel composition may be measured using inductively coupled plasma-atomic emission spectrometry (ICP-AES). C and S may be measured using an infrared absorption method after combustion, N may be measured using an inert gas melting-thermal conductivity method, and O may be measured using an inert gas fusion-nondispersive infrared absorption method.

2. Metallographic Structure

In the high strength steel sheet according to the present embodiment, in the metallographic structure, the total area ratio of tempered martensite and bainite is 80% or more.

(Total Area Ratio of Tempered Martensite and Bainite is 80% or More)

In the present invention, in order to reduce unevenness of structure and property, which is caused by variety of cooling rate in coil during coiling the hot-rolled steel sheet, as much as possible, it is important to set 80% or more of the structure to be bainite and martensite which are low-temperature transformation structure by, for example, cooling the hot-rolled steel sheet to a temperature of 500° C. or less in a cooling zone after hot rolling. The martensite becomes tempered martensite during following tempering. Accordingly, the total area ratio of tempered martensite and bainite with respect to entire structure is 80% or more. When the total area ratio is less than 80%, unevenness of material quality increases, which is not preferable. The total area ratio of tempered martensite and bainite may be 85% or more, 90% or more, or 95% or more. It is not necessary to define the upper limit of the total area ratio of tempered martensite and bainite, and for example, the total area ratio of tempered martensite and bainite may be 100%. On the other hand, ferrite or the like may be included in the steel sheet as a remainder of the metallographic structure. Therefore, the total area ratio of tempered martensite and bainite may be 98% or less, 95% or less, or 92% or less.

In the present invention, the remainder of the metallographic structure may include ferrite, pearlite, residual austenite, fresh martensite, and/or cementite.

Method for Measuring Metallographic Structure

The identification of the above-described structures, the confirmation of the presence positions thereof, and the measurement of the area fractions thereof are carried out by the following methods.

First, a cross section parallel to the rolling direction (that is, a cross section parallel to the rolling direction and perpendicular to the rolled surface) is corroded using a Nital reagent and a reagent disclosed in Japanese Unexamined Patent Application, First Publication No. S59-219473. Regarding the corrosion of the cross section, specifically, a solution prepared by dissolving 1 to 5 g of picric acid in 100 ml of ethanol is used as a solution A, a solution prepared by dissolving 1 to 25 g of sodium thiosulfate and 1 to 5 g of citric acid in 100 ml of water is used as a solution B, the solution A and the solution B are mixed at a proportion of 1:1 to prepare a liquid mixture, and nitric acid is further added and mixed at a proportion of 1.5% to 4% with respect to the total amount of this liquid mixture, thereby preparing a pretreatment liquid. In addition, the above-described pretreatment liquid is added to and mixed with a 2% Nital liquid at a proportion of 10% with respect to the total amount of the 2% Nital liquid, thereby preparing a post-treatment liquid. The cross section parallel to the rolling direction (that is, the cross section parallel to the rolling direction and perpendicular to the rolled surface) is immersed in the pretreatment solution for 3 to 15 seconds, washed with an alcohol, dried, then, immersed in the post-treatment solution for 3 to 20 seconds, then, washed with water, and dried, thereby corroding the cross section.

Next, as shown in FIG. 1, at a position at a depth of ¼ of the sheet thickness from the surface (rolled surface 11) of the steel sheet 1 and at the center in the width direction WD, at least three 40 μm×30 μm regions are observed at a magnification of 1000 to 100,000 times using a scanning electron microscope, thereby identifying the metallographic structure, confirming the presence positions, and measuring the area fractions. In any case where the measurement object is a steel sheet that does not undergo any special machining after manufactured (in other words, a steel sheet that is not cut from a coil) or a steel sheet that is cut from a coil, the width direction central position is a position that is substantially equidistant from both ends of the steel sheet 1 in the width direction WD.

It is difficult to distinguish lower bainite and tempered martensite by the above-described measuring method. Therefore, in the present embodiment, there is no need to distinguish both. That is, the total area fraction of "bainite and tempered martensite" is obtained by measuring the area fractions of "upper bainite" and "lower bainite or tempered martensite". Upper bainite is an aggregate of laths and a structure containing a carbide between the laths. Lower bainite is a structure containing iron-based carbides having major axes of 5 nm or more and extending in the same direction. Tempered martensite is an aggregate of lath-shaped crystal grains and a structure containing iron-based carbides having major axes of 5 nm or more and extending in different directions.

(At sheet thickness ¼ position of cross section parallel to rolling direction and perpendicular to rolled surface, standard deviation of number densities of precipitates having diameter of 10 nm or less and including one or both of Ti and Nb is less than $5\times10^{10}$ numbers/mm$^3$, in which number densities are measured at 10 points every 50 mm in width direction)

In the present invention, precipitates including one or both of Ti and Nb (hereinafter, which are referred as precipitates including Nb/Ti) is important in order to secure elongation and bendability as well as to secure strength. Generally, the strength of the steel sheet tends to be inversely proportional to the elongation and bendability of the steel sheet. However, by using the precipitates including Nb/Ti, the strength of the steel sheet can be enhanced without deteriorating the elongation and bendability.

On the other hand, the strength and elongation vary according to the amount of the precipitates including Nb/Ti, and thus, it is important that the amount of precipitates including Nb/Ti distributed therein is uniform in the width direction (that is, direction perpendicular to rolling direction). When the standard deviation of number densities of precipitates including Ti/Nb is $5\times10^{10}$ numbers/mm$^3$ or more, a variation in mechanical properties is caused, and material quality stability cannot be obtained. Therefore, the standard deviation of the number density of precipitates including Nb/Ti is set to less than $5\times10^{10}$ numbers/mm$^3$, and is preferably less than $4\times10^{10}$ numbers/mm$^3$, or less than $3\times10^{10}$ numbers/mm$^3$.

As long as the chemical composition and the standard deviation of the number density of precipitates including Nb/Ti are within the above-described range, it is assumed that an appropriate amount of precipitates including Nb/Ti for securing the elongation and bendability can be obtained, and thus, it is not necessary to limit the upper limit and the lower limit of the number density itself of precipitates including Nb/Ti. On the other hand, the number density of precipitates including Nb/Ti may be defined as $3.5\times10^{10}$ numbers/mm$^3$ or more, $3.8\times10^{10}$ numbers/mm$^3$ or more, or $4.0\times10^{10}$ numbers/mm$^3$ or more.

The standard deviation of number densities of precipitation including Ti/Nb is measured by the following method.

A replica sample manufactured in accordance with a method described in Japanese Unexamined Patent Application, First Publication No. 2004-317203 is extracted from the sheet thickness ¼ position 121 of the cross section 12 parallel to the rolling direction RD and perpendicular to the rolled surface 11 shown in FIG. 2, and is observed using a transmission electron microscope. The magnification of the observed section is 50,000 times, and in 3 observed sections, the number of the precipitations including Ti/Nb, in which the value obtained as a square root (approximate value of circle equivalent diameter) of <major axis×minor axis> is 10 nm or less, is counted. After that, the counted number of the precipitations including Ti/Nb is divided by the volume of the electrolyzed sample to calculate the total density of the precipitates. The contribution of precipitates, of which the circle equivalent diameter is more than 10 nm, to the precipitation hardening is small, and they do not have large effects on the properties obtained by the present invention. Therefore, the number density of the precipitates, of which the circle equivalent diameter is more than 10 nm, is not limited.

The replica samples are extracted at 10 points every 50 mm in width direction WD (see FIG. 2), and the number densities of the precipitations including Ti/Nb in each samples are obtained. After that, the average value of the number densities of the precipitations including Ti/Nb in each 10 replica samples is assumed to be the number density of the precipitations including Ti/Nb of the steel sheet. In addition, the standard deviation of the number densities of the precipitations including Ti/Nb in each 10 replica samples is assumed to be the standard deviation of the number densities of the precipitations including Ti/Nb of the steel sheet.

When the size of the steel sheet, which is a future measurement object, along the width direction is sufficiently large, the measurement points for the standard deviation of the number densities of precipitations including Ti/Nb may be disposed on one straight line along the width direction. On the other hand, when the size of the steel sheet, which is a future measurement object, along the width direction is less than 450 mm, the measurement points for the standard deviation of the standard deviation of the number densities of precipitations including Ti/Nb may be disposed on two or more straight lines along the width direction. At the time of measuring the standard deviation in the width direction of characteristics other than the number densities of precipitations including Ti/Nb (for example, surface roughness and the like), the measurement points can be disposed as described above.

3. Standard Deviation of Surface Roughnesses Ra (Standard Deviation of Surface Roughnesses Ra Measured at 10 Points Every 50 Mm Along Width Direction being Preferably 1.0 μm or Less)

The steel sheet according to the present embodiment is not particularly limited as long as the chemical composition, the metallographic structure, and the tensile strength described below are within predetermined ranges. When the surface roughnesses Ra of the rolled surface 11 are measured at 10 points every 50 mm along the width direction (that is, a direction at a right angle with respect to the rolling direction), the standard deviation of the surface roughnesses Ra may be set to 1.0 μm or less. When a variation in the surface roughness Ra is suppressed, it is possible to suppress a variation in bending workability and to further enhance material quality stability. Therefore, the standard deviation is preferably set to 1.0 μm or less. Here, the surface roughness of the steel sheet can be changed at will by additional processing. For example, after a high strength steel sheet having excellent material quality stability is manufactured by a preferable manufacturing method described below, processing for changing the surface roughness such as hairline processing may be carried out on this high strength steel sheet. From this viewpoint as well, setting the standard deviation of the surface roughnesses Ra within the above-described range is not essential.

For the surface roughness Ra, a roughness curve that is 5 mm long in the width direction is acquired at each measurement position using a contact type roughness meter (SURFTEST SJ-500 manufactured by Mitutoyo Corporation), and the arithmetic average roughness Ra is obtained by the method described in JIS B0601: 2001. The standard deviation of the surface roughnesses Ra is obtained using the value of the arithmetic average roughnesses Ra at each measurement position obtained as described above.

In addition, in a case where a surface treatment membrane such as a plating or a coating is disposed on the surface of the steel sheet, the "surface roughness Ra of the steel sheet" means the surface roughness that is measured after removing the surface treatment membrane from the steel sheet. That is, the surface roughness Ra of the steel sheet is the surface roughness of the base metal. The method for removing the surface treatment membrane can be appropriately selected according to the type of the surface treatment membrane to an extent that the surface roughness of the base metal is not affected. For example, in a case where the surface treatment membrane is a zinc plating, it is necessary to dissolve the galvanized layer using dilute hydrochloric acid to which an inhibitor is added. This makes it possible to exfoliate only the galvanized layer from the steel sheet. The inhibitor is an additive that is used to suppress a change in roughness attributed to the prevention of the excessive dissolution of the base metal. For example, a substance obtained by adding a corrosion inhibitor for hydrochloric acid pickling "IBIT No. 700BK" manufactured by Asahi Chemical Co., Ltd. to hydrochloric acid diluted 10 to 100 times such that the concentration reaches 0.6 g/L can be used as exfoliation means for the galvanized layer.

4. Mechanical Properties (Tensile Strength TS: 780 MPa or More)

The high strength steel sheet according to the present embodiment has, as a sufficient strength that contributes to the weight reduction of vehicles, a tensile strength (TS) of 780 MPa or more. The tensile strength of the steel sheet may be 800 MPa or more, 900 MPa or more, or 1000 MPa or more. Meanwhile, it is assumed that it is difficult to obtain a tensile strength of more than 1470 MPa with the configuration of the present embodiment. Therefore, it is not necessary to particularly specify the upper limit of the tensile strength, but the substantial upper limit of the tensile strength in the present embodiment can be set to 1470 MPa. In addition, the tensile strength of the steel sheet may be set to 1400 MPa or less, 1300 MPa or less, or 1200 MPa or less.

A tensile test may be carried out in the following order in accordance with JIS Z 2241 (2011). JIS No. 5 test pieces are collected from 10 positions in the high strength steel sheet at intervals of 50 mm in the width direction. Here, the width direction of the steel sheet and the longitudinal direction of the test pieces are made to coincide with each other. In addition, individual test pieces are collected at positions shifted in the rolling direction of the steel sheet such that the collection positions of the individual test pieces do not interfere with each other. Tensile tests are carried out on these test pieces in accordance with the regulations of JIS Z 2241 (2011), tensile strengths TS (MPa) are obtained, and the average value thereof is calculated. This average value is regarded as the tensile strength of the high strength steel sheet.

In addition, the high strength steel sheet according to the present embodiment may have the following characteristics in terms of elongation and hole expansibility as an index of formability. These mechanical properties are obtained due to a variety of properties of the high strength steel sheet according to the present embodiment described above.

(Total Elongation EL: 10% or More)

The high strength steel sheet according to the present embodiment may have a total elongation of 9% or more, or 10% or more in the tensile test as an index of formability. Meanwhile, it is difficult to obtain a total elongation of more than 35% with the configuration of the present embodiment. Therefore, the substantial upper limit of the total elongation may be set to 35%.

(Limit Bend Radius R/t (Bendability): 2.0 or Less)

In the case of using a value R/t obtained by dividing the limit bend radius R (mm) by the sheet thickness t (mm) as an index of bendability, the high strength steel sheet according to the present embodiment may have R/t of 2.0 or less. Meanwhile, it is difficult to set the index R/t of the bendability to 0.1 or less with the configuration of the present embodiment. Therefore, the substantial lower limit of the index R/t of the bendability may be set to 0.1.

The limit bend radius R is obtained by repeatedly carrying out bending tests to which a variety of bend radii are applied. In the bending test, bending is carried out in accordance with JIS Z 2248 (2006) (V block 90° bending test). The bend radius (to be exact, the inner radius of bending) changes at pitches of 0.5 mm. As the bend radius in the bending test decreases, cracks and other defects are more likely to be generated in the steel sheet. The minimum bending at which cracks and other defects are not generated in the steel sheet, which has been obtained in this test, is regarded as the limit bend radius R. In addition, a value obtained by dividing this limit bend radius R by the thickness t of the steel sheet is used as the index R/t for evaluating the bendability.

In the high strength steel sheet according to the present embodiment, as an index of the material quality being stable, among tensile test results measured at 10 points every 50 mm in the width direction (that is, a direction at a right angle with respect to the rolling direction), the standard deviation of TS may be 50 MPa or less, and the standard deviation of EL may be 1% or less. The method for obtaining the TS standard deviation and the EL standard deviation is the same as the above-described tensile test method for obtaining the average value of the tensile strengths. The TS standard deviation and the EL standard deviation can be obtained by obtaining the standard deviation of the results of 10 tensile tests by the above-described method.

In addition, in the high strength steel sheet according to the present embodiment, the standard deviation of R/t (limit bend radius R (mm), the sheet thickness t (mm)) measured at 10 points every 50 mm along the width direction may be set to 0.2 or less.

5. Manufacturing Method

Next, an example of a preferred method for manufacturing the high strength steel sheet according to the present embodiment will be described. However, it should be noted that the method for manufacturing a high strength steel sheet according to the present embodiment is not particularly limited. Any steel sheet that satisfies the above-described requirements is regarded as a steel sheet according to the present embodiment regardless of manufacturing methods therefor.

The manufacturing step preceding hot rolling is not particularly limited. That is, subsequent to melting with a blast furnace, an electric furnace, or the like, a variety of secondary smelting is carried out, and then casting may be carried out by a method such as ordinary continuous casting, casting by an ingot method, or thin slab casting. In the case of the continuous casting, a cast slab may be hot-rolled after being once cooled to a low temperature and then heated again or the cast slab may be hot-rolled as it is after being cast without being cooled to a low temperature. Scrap may be used as a raw material.

A heating step is carried out on the cast slab. In this heating step, the slab is heated to a temperature of 1100° C. or more and 1350° C. or less, and then, held for 30 minutes or more. In a case in which Ti and/or Nb are included therein, it is heated to a temperature of 1200° C. or more and 1350° C. or less, and then, it is held for 30 minutes or more. If the heating temperature is less than 1200° C., Ti and/or Nb, which are precipitation elements, are not sufficiently dissolved so that, in the following hot rolling, a sufficient amount of precipitation hardening cannot be obtained, and Ti and/or Nb retain as coarse carbides and deteriorate the formability, which is not preferable. Therefore, in a case in which Ti and/or Nb are included in the slab, the heating temperature for the slab is 1200° C. or more. On the other hand, if the heating temperature is more than 1350° C., the amount of scale is increased so that the yield decreases, and thus, the heating temperature is 1350° C. or less. It is preferable that the heating holding time is 30 minutes or more in order to sufficiently dissolve Ti and/or Nb. In addition, from the viewpoint of preventing an excessive scale loss, the heating holding time is preferably 10 hours or less, and more preferably 5 hours or less.

Next, a rough rolling step of rough-rolling the heated slab to produce a rough rolled sheet is carried out.

In the rough rolling, conditions therefor are not particularly limited as long as the slab is made into a desired dimension and a desired shape. The thickness of the rough rolled sheet affects the amount of the temperature lowered from the tip to the tail of the hot-rolled steel sheet during the beginning of the rolling to the completion of the rolling in a finish rolling step and is thus preferably determined in consideration of such a fact.

Finish rolling is carried out on the rough rolled sheet. In this finish rolling step, multi-stage finish rolling is carried out. In the present embodiment, finish rolling is carried out within a temperature range of 850° C. to 1200° C. under conditions that satisfy the following formula (1).

$$K'/Si^* \geq 2.50 \quad (1)$$

Here, when Si≥0.35, Si* is set to 140√Si, and, when Si<0.35, Si* is set to 80. Si represents the Si content (mass %) of the steel sheet.

In addition, K' in the formula (1) is represented by the following formula (2).

$$K' = D \times (DT - 930) \times 1.5 + \Sigma((FT_n - 930) \times S_n) \quad (2)$$

Here, D is the amount sprayed per hour ($m^3$/min) of hydraulic descaling before the start of the finish rolling, DT is the steel sheet temperature (° C.) at the time of the hydraulic descaling before the start of the finish rolling, $FT_n$ is the steel sheet temperature (° C.) in the $n^{th}$ stage of the finish rolling, and S, is the amount sprayed per hour ($m^3$/min) at the time of spraying water to the steel sheet on spray between the $n-1^{th}$ stage and the $n^{th}$ stage of the finish rolling.

Si* is a parameter relating to a steel sheet component that indicates the easiness in the generation of unevenness attributed to scale. When the amount of Si in a steel sheet component is large, scale that is generated on the surface layer during hot rolling changes from wustite (FeO) to fayalite ($Fe_2SiO_4$), in which the wustite is relatively easily descaled and is unlikely to produce unevenness on the steel sheet and the fayalite grows so as to lay down roots in the steel sheet and is likely to produce unevenness. Therefore, as the amount of Si increases, that is, as the Si* increases, unevenness on the surface layer is more likely to be formed. Here, the addition of Si to facilitate the formation of unevenness on the surface layer becomes significantly effective particularly when 0.35 mass % or more of Si is added. Therefore, when 0.35 mass % or more of Si is added, Si* acts as a function of Si; however, when 0.35 mass % or less of Si is added, Si* acts as a constant.

K' is a parameter of a manufacturing condition that indicates the difficulty in forming unevenness. The first item of the formula (2) indicates that, when hydraulic descaling is carried out before the start of the finish rolling in order to suppress the formation of unevenness, as the amount sprayed per hour of the hydraulic descaling increases and as the steel sheet temperature increases, the hydraulic descaling becomes more effective from the viewpoint of descaling. When a plurality of times of descaling is carried out before the start of the finish rolling, the value of descaling that is closest to the finish rolling is used.

The second item of the formula (2) is an item that indicates the effect of descaling, during finish rolling, scale that has not been completely exfoliated by descaling before finishing or scale that is formed again during the finish rolling and indicates that spraying a large amount of water onto spray to the steel sheet at high temperatures facilitates descaling.

When the ratio of the parameter K' of the manufacturing condition that indicates the difficulty in forming unevenness to the parameter Si* relating to the steel sheet component that indicates the easiness in forming a scale flaw portion is 2.50 or more, it is possible to sufficiently suppress unevenness and to suppress a temperature variation during tempering. Therefore, K'/Si* is set to 2.50 or more, preferably 3.00 or more, and more preferably 3.50 or more.

In order to set the standard deviation of the surface roughnesses Ra measured at 10 positions at intervals of 50 mm in the width direction (that is, a direction at a right angle with respect to the rolling direction) to 0.5 μm or less, which is a preferable form in the present invention, it is preferable that K'/Si≥3.00.

Following the finish rolling, cooling is carried out at an average cooling rate of 50° C./s or faster, and coiling is carried out at a coiling temperature of 450° C. or lower. This is because the unevenness of properties caused by temperature history after coiling is suppressed by including bainite and martensite, which are low-temperature transformation structures, as the main structures as described above. Here, the average cooling rate is a value obtained by dividing the difference in temperature between the start of the cooling and before the coiling by the time therebetween. When the average cooling rate is slower than 50° C./s, it becomes difficult to set the total area ratio of bainite and tempered martensite to 80% or more of all structures.

Similarly, when the coiling temperature is higher than 450° C., it becomes difficult to set the total area ratio of bainite and tempered martensite to 80% or more of all structures. From this viewpoint, the coiling temperature is set to 450° C. or lower, preferably set to 400° C. or lower, and more preferably set to 200° C. or lower. In addition, setting the coiling temperature to 450° C. or lower also has an effect of suppressing the formation of an internal oxide on the surface of the steel sheet after the coiling and an increase in the roughness of the surface layer.

Pickling is carried out on the high strength steel sheet manufactured in this manner for the purpose of removing an oxide on the surface of the steel sheet. The pickling may be carried out, for example, with hydrochloric acid having a concentration of 3% to 10% at a temperature of 85° C. to 98° C. for 20 seconds to 100 seconds.

In addition, soft reduction with a rolling reduction of 20% or smaller may be carried out on the manufactured hot-rolled steel sheet. The aim of the soft reduction is to introduce dislocations, which act as precipitation sites of the precipitations during tempering, and in a case in which the soft reduction is performed, strength can be easily obtained and the effect of shape correction is obtained, and thus, it is preferable. The soft reduction may be carried out before the pickling or carried out after the pickling. The soft reduction being carried out after the pickling has an effect of further reducing the roughness of the surface layer. In order to set the standard deviation of the surface roughnesses Ra to 0.5 μm or less when the surface roughnesses Ra are measured at 10 positions at intervals of 50 mm in the width direction (that is, a direction at a right angle with respect to the rolling direction), which is a preferable form in the present invention, it is necessary to carry out the soft reduction after the pickling.

The obtained steel sheet is tempered (heated) in 550° C. to 750° C. for 10 second to 1000 second. The aim of the tempering is to recovery dislocations in the low-temperature transformation structure so that the elongation is enhanced, as well as to precipitate the precipitations including Ti and/or Ni so that the strength is obtained.

When the tempering temperature is less than 550° C., elongation cannot be sufficiently secured as well as strength cannot be secured, which is not preferable. When heating is performed with the tempering temperature being more than 750° C., coarsening of precipitates occurs so that strength cannot be secured, which is not preferable. Therefore, in the manufacturing method for the high strength steel sheet according to the present embodiment, the tempering temperature is 550° C. to 750° C.

When the heating time is less than 10 seconds, elongation cannot be sufficiently secured as well as strength cannot be secured, which is not preferable. When heating is performed with the heating time being more than 1000 seconds, the effect of enhancing elongation due to recovery of dislocations and the effect of enhancing strength due to precipitation are saturated, and thus, in consideration of productivity, the heating time is 1000 seconds or less. Therefore, in the manufacturing method for the high strength steel sheet according to the present embodiment, the tempering time is 10 seconds to 1000 seconds.

Hot-dip galvanizing or hot-dip galvannealing may be carried out after heating. By decreasing the roughness of the surface by using the technique according to the present patent, wettability of the hot-dip galvanized steel sheet is enhanced, as well as the effect of applying uniform plating can be obtained.

The high strength steel sheet according to the present embodiment can be manufactured by the above-described manufacturing method.

EXAMPLES

Hereinafter, the high strength steel sheet according to the present invention will be described more specifically with reference to examples. Here, the following examples are examples of the high strength steel sheet of the present invention, and the high strength steel sheet of the present invention is not limited to the following aspects. Conditions in examples to be described below are exemplary conditions adopted to confirm the feasibility and effects of the present invention, and the present invention is not limited to these exemplary conditions. The present invention is capable of adopting a variety of conditions within the scope of the gist of the present invention as long as the object of the present invention is achieved.

Steels having chemical compositions shown in Table 1 were cast, after the casting, slabs were heated to a temperature range of 1200° C. to 1350° C. as they were or after being once cooled to room temperature and then retained, and then the slabs were rough-rolled at temperatures of 1100° C. or higher, thereby producing rough-rolled steel sheets. In Table 1, values outside the scope of the invention are underlined.

TABLE 1

| Steel | Chemical composition (Unit: mass %, remainder is Fe and impurities) | | | | | | | | | | | | |
|---|---|---|---|---|---|---|---|---|---|---|---|---|---|
| material | C | Si | Mn | sol. Al | Ti | Nb | P | S | N | O | Others | Ti + Nb | Category |
| A | 0.061 | 1.21 | 2.59 | 0.100 | 0.11 | 0.02 | 0.010 | 0.0020 | 0.00200 | 0.00100 | B: 0001 | 0.13 | Example |
| B | 0.060 | 0.10 | 2.49 | 0.030 | 0.00 | 0.05 | 0.010 | 0.0010 | 0.00200 | 0.00100 | | 0.05 | Example |
| C | 0.069 | 0.80 | 2.20 | 0.050 | 0.12 | 0.02 | 0.010 | 0.0010 | 0.00300 | 0.00200 | Ca: 0.002 | 0.14 | Example |
| D | 0.050 | 0.40 | 2.09 | 0.030 | 0.10 | 0.00 | 0.008 | 0.0010 | 0.00300 | 0.00100 | B: 0.002 | 0.10 | Example |
| E | 0.061 | 1.49 | 2.20 | 0.030 | 0.11 | 0.02 | 0.010 | 0.0020 | 0.00300 | 0.00100 | | 0.13 | Example |
| F | 0.080 | 2.00 | 2.00 | 0.025 | 0.09 | 0.01 | 0.010 | 0.0010 | 0.00300 | 0.00200 | Cr: 0.4 | 0.10 | Example |
| G | 0.059 | 0.70 | 1.81 | 0.030 | 0.10 | 0.01 | 0.011 | 0.0010 | 0.00300 | 0.00100 | V: 0.01 | 0.11 | Example |
| H | 0.121 | 1.30 | 1.80 | 0.020 | 0.09 | 0.01 | 0.012 | 0.0010 | 0.00300 | 0.00100 | Mo: 0.01 | 0.10 | Example |
| I | 0.040 | 1.10 | 1.61 | 0.020 | 0.11 | 0.01 | 0.010 | 0.0010 | 0.00200 | 0.00200 | Cu: 0.01 | 0.12 | Example |
| J | 0.061 | 1.02 | 1.79 | 0.030 | 0.10 | 0.02 | 0.010 | 0.0010 | 0.00300 | 0.00100 | Co: 0.1 | 0.12 | Example |
| K | 0.080 | 0.90 | 1.88 | 0.029 | 0.16 | 0.02 | 0.010 | 0.0010 | 0.00300 | 0.00100 | B: 0.001, W: 0.01 | 0.18 | Example |
| L | 0.071 | 1.79 | 1.09 | 0.020 | 0.11 | 0.01 | 0.012 | 0.0030 | 0.00300 | 0.00100 | Ni: 0.8 | 0.12 | Example |
| M | 0.110 | 1.20 | 1.79 | 0.021 | 0.10 | 0.03 | 0.013 | 0.0010 | 0.00200 | 0.00100 | Mg: 0.002 | 0.13 | Example |
| N | 0.079 | 0.87 | 1.30 | 0.030 | 0.08 | 0.02 | 0.011 | 0.0020 | 0.00300 | 0.00100 | REM: 0.001 | 0.10 | Example |
| O | 0.089 | 1.43 | 1.79 | 0.130 | 0.12 | 0.03 | 0.014 | 0.0010 | 0.00200 | 0.00100 | Zr: 0.002 | 0.15 | Example |
| P | 0.050 | 0.90 | 1.60 | 0.030 | 0.03 | 0.04 | 0.010 | 0.0030 | 0.00300 | 0.00100 | B: 0.002 | 0.07 | Example |
| Q | 0.048 | 1.10 | 1.59 | 0.030 | 0.01 | 0.01 | 0.010 | 0.0030 | 0.00300 | 0.00100 | B: 0.002 | 0.02 | Comparative example |
| R | 0.150 | 1.10 | 3.01 | 0.030 | 0.15 | 0.10 | 0.010 | 0.0030 | 0.00300 | 0.00100 | W: 0.05, Ca: 0.005 | 0.25 | Example |

On the rough rolled sheets, multi-stage finish rolling including a total of seven stages was carried out under conditions shown in Table 2 and Table 3.

After that, cooling and coiling after finish rolling were carried out under individual conditions shown in Table 4 and Table 5.

After that, pickling was carried out for all conditions; however, for some of the conditions, soft reduction was carried out in a step before or after the pickling After that, the steel sheets were heated up to tempering temperature at speeds of heating speeds of 30° C./s to 150° C./s, and then, tempered with tempering temperatures and times described in Table 4 and Table 5. After that, for some of the conditions, hot-dip galvannealing or hot-dip galvanizing was carried out. In the plating step, the steel sheets were in a temperature range of 400° C. to 520° C.

TABLE 2

| Remarks | No. | Steel type | Thickness (mm) | Amount of Si (%) | Steel sheet temperature (° C.) in $n^{th}$ stage of finish rolling | | | | | | | Amount sprayed per hour during hydraulic descaling ($m^3$/min) | | | | | | | |
|---|---|---|---|---|---|---|---|---|---|---|---|---|---|---|---|---|---|---|---|
| | | | | | $FT_1$ | $FT_2$ | $FT_3$ | $FT_4$ | $FT_5$ | $FT_6$ | $FT_7$ | Before finish rolling | $S_1$ | $S_2$ | $S_3$ | $S_4$ | $S_5$ | $S_6$ | $S_7$ |
| Comparative example | 1 | A | 2.8 | 1.21 | 1005 | 995 | 986 | 977 | 968 | 959 | 950 | 1 | 0.4 | 0 | 1 | 0 | 0 | 0.0 | 0 |
| Comparative example | 2 | A | 2.8 | 1.21 | 1009 | 1000 | 991 | 982 | 972 | 963 | 954 | 1 | 0.4 | 0 | 1.2 | 0 | 0 | 0.2 | 2.4 |
| Comparative example | 3 | A | 2.8 | 1.21 | 1004 | 995 | 986 | 977 | 968 | 958 | 949 | 1 | 0.4 | 1 | 1.2 | 1 | 0 | 1.5 | 2.4 |
| Comparative example | 4 | A | 2.8 | 1.21 | 1006 | 997 | 988 | 979 | 970 | 960 | 951 | 1 | 0.4 | 1 | 1.2 | 1 | 0 | 1.5 | 2.4 |
| Comparative example | 5 | A | 2.8 | 1.21 | 1010 | 1001 | 992 | 982 | 973 | 964 | 955 | 1 | 0.4 | 1 | 1.2 | 1 | 0 | 1.5 | 2.4 |
| Comparative example | 6 | A | 2.8 | 1.21 | 1007 | 998 | 989 | 980 | 970 | 961 | 952 | 1 | 0.4 | 1 | 1.2 | 1 | 0 | 1.5 | 2.4 |
| Example | 7 | A | 2.0 | 1.21 | 1010 | 1001 | 992 | 983 | 974 | 965 | 955 | 1 | 0.4 | 1 | 2.4 | 1 | 0 | 1.5 | 2.4 |
| Example | 8 | A | 2.4 | 1.21 | 1001 | 991 | 982 | 973 | 964 | 955 | 946 | 3 | 0.4 | 1 | 2.4 | 1 | 0 | 1.5 | 2.4 |
| Example | 9 | A | 1.2 | 1.21 | 1002 | 992 | 983 | 974 | 965 | 956 | 947 | 1 | 0.4 | 1 | 2.4 | 1 | 0 | 1.5 | 2.4 |
| Example | 10 | A | 1.2 | 1.21 | 1004 | 995 | 986 | 977 | 968 | 959 | 949 | 1 | 0.4 | 1 | 2.4 | 1 | 0 | 1.5 | 2.4 |
| Example | 11 | A | 1.2 | 1.21 | 1005 | 996 | 987 | 978 | 969 | 959 | 950 | 1 | 0.4 | 1 | 2.4 | 1 | 0 | 1.5 | 2.4 |
| Example | 12 | A | 2.0 | 1.21 | 1002 | 992 | 983 | 974 | 965 | 956 | 947 | 1 | 0.4 | 1 | 2.4 | 1 | 0 | 1.5 | 2.4 |
| Example | 13 | A | 2.0 | 1.21 | 1005 | 996 | 987 | 978 | 968 | 959 | 950 | 1 | 0.4 | 1 | 2.4 | 1 | 0 | 1.5 | 2.4 |
| Example | 14 | A | 2.0 | 1.21 | 1000 | 990 | 981 | 972 | 963 | 954 | 945 | 1 | 0.4 | 1 | 2.4 | 1 | 0 | 1.5 | 2.4 |
| Example | 15 | A | 2.0 | 1.21 | 1005 | 996 | 987 | 977 | 968 | 959 | 950 | 1 | 0.4 | 1 | 2.4 | 1 | 0 | 1.5 | 2.4 |
| Example | 16 | A | 3.8 | 1.21 | 1004 | 995 | 986 | 977 | 968 | 958 | 949 | 1 | 0.4 | 1 | 2.4 | 1 | 0 | 1.5 | 2.4 |
| Example | 17 | A | 2.0 | 1.21 | 1004 | 995 | 985 | 976 | 967 | 958 | 949 | 1 | 0.4 | 1 | 2.4 | 1 | 0 | 1.5 | 2.4 |
| Example | 18 | A | 2.0 | 1.21 | 1010 | 1000 | 991 | 982 | 973 | 964 | 955 | 1 | 0.4 | 1 | 2.4 | 1 | 0 | 1.5 | 2.4 |
| Example | 19 | A | 2.0 | 1.21 | 1008 | 999 | 990 | 981 | 972 | 962 | 953 | 1 | 0.4 | 1 | 2.4 | 1 | 0 | 1.5 | 2.4 |
| Example | 20 | A | 2.2 | 1.21 | 1067 | 1048 | 1029 | 1010 | 991 | 972 | 952 | 1 | 0.4 | 0 | 1.2 | 0 | 0 | 0 | 2.4 |
| Example | 21 | B | 2.0 | 0.10 | 1027 | 1008 | 986 | 971 | 944 | 927 | 905 | 1 | 0 | 0 | 1.8 | 0 | 0 | 0.4 | 0.4 |
| Example | 22 | B | 2.0 | 0.10 | 1029 | 1010 | 988 | 973 | 946 | 929 | 907 | 1 | 0 | 0 | 1.8 | 0 | 0 | 0.4 | 0.4 |
| Example | 23 | C | 2.9 | 0.80 | 1069 | 1050 | 1031 | 1012 | 993 | 974 | 954 | 1 | 0.4 | 0 | 1.2 | 0 | 0 | 0 | 2.4 |

TABLE 3

| Remarks | No. | Steel type | Thickness (mm) | Amount of Si (%) | Steel sheet temperature (° C.) in $n^{th}$ stage of finish rolling | | | | | | | Amount sprayed per hour during hydraulic descaling ($m^3$/min) | | | | | | | |
|---|---|---|---|---|---|---|---|---|---|---|---|---|---|---|---|---|---|---|---|
| | | | | | $FT_1$ | $FT_2$ | $FT_3$ | $FT_4$ | $FT_5$ | $FT_6$ | $FT_7$ | Before finish rolling | $S_1$ | $S_2$ | $S_3$ | $S_4$ | $S_5$ | $S_6$ | $S_7$ |
| Comparative example | 24 | D | 2.9 | 0.40 | 1008 | 999 | 990 | 980 | 971 | 962 | 953 | 1 | 0.4 | 0 | 1.2 | 0 | 0 | 0 | 0 |
| Example | 25 | D | 2.9 | 0.40 | 1002 | 993 | 984 | 975 | 965 | 956 | 947 | 1 | 0.4 | 0 | 1.2 | 0 | 0 | 0 | 2.4 |
| Example | 26 | D | 2.9 | 0.40 | 1083 | 1067 | 1052 | 1037 | 1022 | 1007 | 992 | 1 | 0.4 | 0 | 1.2 | 0 | 0 | 0 | 2.4 |
| Example | 27 | D | 2.9 | 0.40 | 1082 | 1067 | 1052 | 1037 | 1021 | 1006 | 991 | 1 | 0.4 | 0 | 1.2 | 0 | 0 | 0 | 2.4 |
| Example | 28 | D | 2.9 | 0.40 | 1079 | 1063 | 1048 | 1033 | 1018 | 1003 | 988 | 1 | 0.4 | 0 | 1.2 | 0 | 0 | 0 | 2.4 |
| Example | 29 | E | 2.9 | 1.49 | 1063 | 1044 | 1025 | 1006 | 987 | 967 | 948 | 1 | 0.4 | 1 | 1.2 | 0 | 0 | 0 | 2.4 |
| Example | 30 | F | 2.9 | 2.00 | 1076 | 1057 | 1038 | 1019 | 1000 | 980 | 961 | 1 | 0.4 | 1 | 1.2 | 0 | 0 | 0 | 2.4 |
| Example | 31 | G | 2.9 | 0.70 | 1073 | 1054 | 1035 | 1015 | 996 | 977 | 958 | 1 | 0.4 | 0 | 1.2 | 0 | 0 | 0 | 2.4 |
| Example | 32 | H | 2.9 | 1.30 | 1061 | 1041 | 1022 | 1003 | 984 | 965 | 946 | 2 | 0.4 | 0 | 1.2 | 0 | 0 | 0 | 2.4 |
| Example | 33 | I | 2.9 | 1.10 | 1055 | 1036 | 1017 | 998 | 978 | 959 | 940 | 1 | 0.4 | 0 | 1.2 | 1 | 1 | 1 | 2.4 |
| Example | 34 | J | 2.9 | 1.02 | 1057 | 1037 | 1018 | 999 | 980 | 961 | 942 | 1 | 0.4 | 0 | 1.2 | 1 | 1 | 1 | 2.4 |
| Example | 35 | K | 2.9 | 0.90 | 1064 | 1044 | 1025 | 1006 | 987 | 968 | 949 | 1 | 0.4 | 0 | 1.2 | 1 | 1 | 1 | 2.4 |
| Example | 36 | L | 2.9 | 1.79 | 1032 | 1012 | 987 | 978 | 969 | 960 | 951 | 1 | 0.4 | 1 | 2.4 | 1 | 1 | 1.5 | 2.4 |
| Example | 37 | M | 2.9 | 1.20 | 1002 | 993 | 985 | 973 | 966 | 957 | 947 | 1 | 0.4 | 1 | 2.4 | 1 | 0 | 1.5 | 2.4 |
| Example | 38 | N | 2.9 | 0.87 | 1070 | 1051 | 1032 | 1012 | 993 | 974 | 955 | 1 | 0.4 | 0 | 1.2 | 0 | 0 | 0 | 2.4 |
| Example | 39 | O | 2.9 | 1.43 | 1059 | 1040 | 1021 | 1001 | 982 | 963 | 944 | 2 | 0.4 | 0 | 1.2 | 0 | 0 | 0 | 2.4 |
| Example | 40 | P | 2.9 | 0.90 | 1070 | 1051 | 1032 | 1013 | 993 | 974 | 955 | 1 | 0.4 | 0 | 1.2 | 0 | 0 | 0 | 2.4 |
| Comparative example | 41 | Q | 2.9 | 1.10 | 1062 | 1042 | 1023 | 1004 | 985 | 966 | 947 | 1 | 0.4 | 0 | 1.2 | 1 | 1 | 0 | 2.4 |
| Example | 42 | R | 2.0 | 1.10 | 1009 | 1002 | 993 | 983 | 975 | 965 | 956 | 1 | 0.4 | 1 | 1.8 | 1 | 0 | 1.5 | 2.4 |
| Example | 43 | A | 2.8 | 1.21 | 1006 | 998 | 989 | 981 | 970 | 960 | 950 | 1 | 0.4 | 1 | 1.2 | 1 | 0 | 1.5 | 2.4 |

TABLE 4

| Remarks | No. | Average cooling rate after finish rolling (° C./seconds) | Coiling temperature (° C.) | Soft reduction ratio (%) | Timing of soft reduction | Tempering temperature (° C.) | Tempering time (seconds) | Type of plating |
|---|---|---|---|---|---|---|---|---|
| Comparative example | 1 | 100 | ≤100° C. | 5 | After pickling | 649 | 100 | Hot-dip galvannealing |
| Comparative example | 2 | 100 | ≤100° C. | 5 | After pickling | 652 | 100 | Hot-dip galvannealing |
| Comparative example | 3 | 30 | ≤100° C. | 5 | After pickling | 650 | 100 | Hot-dip galvannealing |
| Comparative example | 4 | 60 | 500° C. | 5 | After pickling | 654 | 100 | Hot-dip galvannealing |
| Comparative example | 5 | 60 | ≤100° C. | 5 | After pickling | 772 | 100 | Hot-dip galvannealing |
| Comparative example | 6 | 60 | ≤100° C. | 5 | After pickling | 652 | 5 | Hot-dip galvannealing |
| Example | 7 | 100 | ≤100° C. | 5 | After pickling | 651 | 100 | Hot-dip galvannealing |
| Example | 8 | 100 | ≤100° C. | 5 | After pickling | 652 | 100 | Hot-dip galvannealing |
| Example | 9 | 100 | 430° C. | 5 | After pickling | 647 | 100 | Hot-dip galvannealing |
| Example | 10 | 100 | ≤100° C. | 0 | — | 653 | 100 | Hot-dip galvannealing |
| Example | 11 | 100 | ≤100° C. | 5 | Before pickling | 648 | 100 | Hot-dip galvannealing |
| Example | 12 | 100 | ≤100° C. | 10 | After pickling | 652 | 100 | Hot-dip galvannealing |
| Example | 13 | 100 | ≤100° C. | 10 | Before pickling | 652 | 100 | Hot-dip galvannealing |
| Example | 14 | 100 | ≤100° C. | 5 | After pickling | 568 | 100 | Hot-dip galvannealing |
| Example | 15 | 100 | ≤100° C. | 5 | After pickling | 717 | 100 | Hot-dip galvannealing |
| Example | 16 | 100 | 250° C. | 5 | After pickling | 650 | 30 | Hot-dip galvannealing |
| Example | 17 | 100 | ≤100° C. | 5 | After pickling | 650 | 500 | Hot-dip galvannealing |
| Example | 18 | 60 | ≤100° C. | 5 | After pickling | 649 | 100 | No plating |
| Example | 19 | 100 | ≤100° C. | 5 | After pickling | 646 | 100 | Hot-dip galvanizing |
| Example | 20 | 100 | ≤100° C. | 5 | After pickling | 646 | 100 | Hot-dip galvannealing |
| Example | 21 | 100 | ≤100° C. | 5 | After pickling | 647 | 100 | Hot-dip galvannealing |
| Example | 22 | 100 | ≤100° C. | 5 | After pickling | 500 | 100 | Hot-dip galvannealing |
| Example | 23 | 100 | 150° C. | 5 | After pickling | 649 | 100 | Hot-dip galvannealing |

TABLE 5

| Remarks | No. | Average cooling rate after finish rolling (° C./seconds) | Coiling temperature (° C.) | Soft reduction ratio (%) | Soft reduction process | Tempering temperature (° C.) | Tempering time (seconds) | Type of plating |
|---|---|---|---|---|---|---|---|---|
| Comparative example | 24 | 100 | ≤100° C. | 5 | After pickling | 648 | 100 | Hot-dip galvannealing |
| Example | 25 | 100 | ≤100° C. | 5 | After pickling | 650 | 100 | Hot-dip galvannealing |
| Example | 26 | 100 | ≤100° C. | 0 | — | 648 | 100 | Hot-dip galvanizing |
| Example | 27 | 100 | ≤100° C. | 5 | Before pickling | 650 | 100 | No plating |
| Example | 28 | 100 | ≤100° C. | 10 | After pickling | 648 | 100 | Hot-dip galvannealing |
| Example | 29 | 100 | ≤100° C. | 5 | After pickling | 648 | 100 | Hot-dip galvannealing |
| Example | 30 | 100 | ≤100° C. | 5 | After pickling | 650 | 100 | Hot-dip galvannealing |
| Example | 31 | 100 | ≤100° C. | 5 | After pickling | 647 | 100 | Hot-dip galvannealing |
| Example | 32 | 100 | ≤100° C. | 5 | After pickling | 652 | 100 | Hot-dip galvannealing |
| Example | 33 | 100 | ≤100° C. | 5 | After pickling | 648 | 100 | Hot-dip galvannealing |
| Example | 34 | 100 | ≤100° C. | 5 | After pickling | 652 | 100 | Hot-dip galvannealing |
| Example | 35 | 100 | ≤100° C. | 5 | After pickling | 646 | 100 | Hot-dip galvannealing |
| Example | 36 | 100 | ≤100° C. | 5 | After pickling | 646 | 100 | Hot-dip galvannealing |
| Example | 37 | 100 | ≤100° C. | 5 | After pickling | 651 | 100 | Hot-dip galvannealing |
| Example | 38 | 100 | ≤100° C. | 5 | After pickling | 648 | 100 | Hot-dip galvannealing |
| Example | 39 | 100 | ≤100° C. | 5 | After pickling | 647 | 100 | Hot-dip galvannealing |
| Example | 40 | 100 | ≤100° C. | 5 | After pickling | 646 | 100 | Hot-dip galvannealing |
| Comparative example | 41 | 100 | ≤100° C. | 5 | After pickling | 649 | 100 | Hot-dip galvannealing |
| Example | 42 | 100 | ≤100° C. | 5 | After pickling | 650 | 100 | Hot-dip galvannealing |
| Example | 43 | 60 | ≤100° C. | 5 | After pickling | 652 | 15 | Hot-dip galvannealing |

The metallographic structures of the obtained high strength steel sheets were observed by the following method.

First, a cross section parallel to the rolling direction and perpendicular to the rolled surface was corroded using a Nital reagent and a reagent disclosed in Japanese Unexamined Patent Application, First Publication No. S59-219473. Regarding the corrosion of the cross section, specifically, a solution prepared by dissolving 1 to 5 g of picric acid in 100 ml of ethanol was used as a solution A, a solution prepared by dissolving 1 to 25 g of sodium thiosulfate and 1 to 5 g of citric acid in 100 ml of water was used as a solution B, the solution A and the solution B were mixed at a proportion of 1:1 to prepare a liquid mixture, and nitric acid was further added and mixed at a proportion of 1.5% to 4% with respect to the total amount of this liquid mixture, thereby preparing a pretreatment liquid. In addition, the above-described pretreatment liquid was added to and mixed with a 2% Nital liquid at a proportion of 10% with respect to the total amount of the 2% Nital liquid, thereby preparing a post-treatment liquid. The cross section parallel to the rolling direction and perpendicular to the rolled surface was immersed in the pretreatment solution for 3 to 15 seconds, washed with an alcohol, dried, then, immersed in the post-treatment solution for 3 to 20 seconds, then, washed with water, and dried, thereby corroding the cross section.

Next, at a position at a depth of ¼ of the sheet thickness from the surface of the steel sheet and at the center in the width direction, at least three 40 μm×30 μm regions were observed at a magnification of 1000 to 100,000 times using a scanning electron microscope, thereby identifying the metallographic structure, confirming the presence positions, and measuring the area fractions.

The total area fraction of "bainite and tempered martensite" was obtained by measuring the area fractions of "upper bainite" and "lower bainite or tempered martensite".

The number densities and the standard deviation thereof of precipitation including Ti/Nb is measured by the following method.

A replica sample manufactured in accordance with a method described in Japanese Unexamined Patent Application, First Publication No. 2004-317203 was extracted from the sheet thickness ¼ position 121 of the cross section 12 parallel to the rolling direction RD and perpendicular to the rolled surface 11 shown in FIG. 2, and was observed using a transmission electron microscope. The magnification of the observed section was 50,000 times, and in 3 observed sections, the number of the precipitations including Ti/Nb, in which the value obtained as a square root (approximate value of circle equivalent diameter) of <major axis×minor axis> is 10 nm or less, was counted. After that, the counted number is divided by the volume of the electrolyzed sample to calculate the total density of the precipitations.

The replica samples were extracted at 10 points every 50 mm in width direction, and the number densities of the precipitations including Ti/Nb in each sample were obtained. After that, the average value of the number densities of the precipitations including Ti/Nb in each 10 replica samples was assumed to be the number density of the precipitations including Ti/Nb of the steel sheet. In addition, the standard deviation of the number densities of the precipitations including Ti/Nb in each 10 replica samples was assumed to be the standard deviation of the number densities of the precipitations including Ti/Nb of the steel sheet.

The standard deviation of the surface roughnesses Ra that was measured at 10 positions at intervals of 50 mm in the direction perpendicular to the rolling direction was obtained in the following order. A roughness curve that was 5 mm long in the direction perpendicular to the rolling direction was acquired at each measurement position using a contact type roughness meter (SURFTEST SJ-500 manufactured by Mitutoyo Corporation), and the arithmetic average roughness Ra was obtained by the method described in JIS B0601: 2001. The standard deviation of the surface roughnesses Ra was obtained using the values of the arithmetic average roughness Ra at each measurement position obtained as described above.

Regarding the tensile strength, a tensile test was carried out in accordance with the regulations of JIS Z 2241 (2011) using a JIS No. 5 test piece collected from the high strength steel sheet in a manner that the direction (C direction) perpendicular to the rolling direction was along the longitudinal direction, and the tensile strength TS (MPa) and the butt elongation (total elongation) EL (%) were obtained. The samples were collected from 10 positions in the steel sheet at intervals of 50 mm in the width direction. The average value of the tensile strengths of the 10 test pieces was regarded as the tensile strength TS of the steel sheet, and, in a case where TS≥780 MPa was satisfied, the steel sheet was determined as a high strength hot-rolled steel sheet and evaluated as pass.

In addition, the standard deviations of TS's and EL's at 10 positions at intervals of 50 mm in the width direction in the steel sheets were obtained. A steel sheet having a standard deviation of TS of 50 MPa or less and a standard deviation of EL of 1% or less was determined as a steel sheet having excellent material quality stability.

A bending test was carried out in accordance with JIS Z 2248 (V block 90° bending test), and the bend R (mm) was tested at pitches of 0.5 mm.

In addition, R/t's were measured at 10 positions at intervals of 50 mm in the width direction (direction perpendicular to rolling direction), and the standard deviation thereof was obtained.

TABLE 6

| Remarks | No. | Si* | K' | K'/Si* | Total area ratio of tempered martensite and bainite (%) | Average of number density of precipitates ($10^{10}$ Numbers/mm$^3$) | Standard deviation of precipitates ($10^{10}$ Numbers/mm$^3$) |
|---|---|---|---|---|---|---|---|
| Comparative example | 1 | 154 | 198 | 1.28 | 95 | 12.1 | 7.0 |
| Comparative example | 2 | 154 | 286 | 1.86 | 96 | 11.1 | 6.0 |
| Comparative example | 3 | 154 | 409 | 2.66 | 69 | 11.5 | 6.5 |
| Comparative example | 4 | 154 | 426 | 2.77 | 49 | 11.6 | 6.8 |
| Comparative example | 5 | 154 | 459 | 2.98 | 95 | 3.3 | 2.3 |
| Comparative example | 6 | 154 | 434 | 2.82 | 95 | 2.2 | 2.3 |
| Example | 7 | 154 | 559 | 3.63 | 96 | 10.5 | 2.0 |
| Example | 8 | 154 | 668 | 4.34 | 96 | 11.0 | 2.1 |
| Example | 9 | 154 | 466 | 3.03 | 82 | 11.3 | 2.6 |
| Example | 10 | 154 | 496 | 3.22 | 95 | 10.9 | 4.1 |
| Example | 11 | 154 | 504 | 3.27 | 94 | 11.0 | 4.1 |
| Example | 12 | 154 | 465 | 3.02 | 96 | 11.5 | 2.7 |
| Example | 13 | 154 | 503 | 3.27 | 95 | 12.0 | 4.0 |
| Example | 14 | 154 | 445 | 2.89 | 95 | 11.6 | 2.7 |
| Example | 15 | 154 | 501 | 3.25 | 94 | 11.7 | 2.8 |
| Example | 16 | 154 | 494 | 3.21 | 85 | 11.1 | 2.5 |

TABLE 6-continued

| | | | | | | | |
|---|---|---|---|---|---|---|---|
| Example | 17 | 154 | 488 | 3.17 | 96 | 11.1 | 2.7 |
| Example | 18 | 154 | 550 | 3.57 | 91 | 11.5 | 2.0 |
| Example | 19 | 154 | 536 | 3.48 | 94 | 11.3 | 2.2 |
| Example | 20 | 154 | 434 | 2.82 | 94 | 12.3 | 4.2 |
| Example | 21 | 80 | 232 | 2.89 | 94 | 6.2 | 4.1 |
| Comparative example | 22 | 80 | 238 | 2.98 | 94 | 3.3 | 3.6 |
| Example | 23 | 125 | 445 | 3.55 | 95 | 10.5 | 2.0 |

| Remarks | No. | Standard deviation of roughness (μm) | Average tensile strength TS (MPa) | TS Standard deviation (MPa) | Average total elongation EL (%) | EL standard deviation (%) | Average limit bend radius R/t | R/t standard deviation |
|---|---|---|---|---|---|---|---|---|
| Comparative example | 1 | 1.2 | 1050 | 75 | 14.3 | 1.3 | 1.5 | 0.3 |
| Comparative example | 2 | 1.1 | 1050 | 70 | 14.6 | 1.2 | 1.5 | 0.3 |
| Comparative example | 3 | 0.8 | 950 | 63 | 17.2 | 1.2 | 1.4 | 0.3 |
| Comparative example | 4 | 1.3 | 930 | 61 | 18.5 | 1.3 | 1.4 | 0.4 |
| Comparative example | 5 | 0.7 | 750 | 35 | 8.5 | 0.3 | 1.2 | 0.3 |
| Comparative example | 6 | 0.7 | 750 | 34 | 8.8 | 0.3 | 1.2 | 0.3 |
| Example | 7 | 0.4 | 1050 | 5 | 14.7 | 0.3 | 1.2 | 0.1 |
| Example | 8 | 0.4 | 1050 | 12 | 14.5 | 0.4 | 1.2 | 0.1 |
| Example | 9 | 0.4 | 1010 | 7 | 16.2 | 0.4 | 1.1 | 0.1 |
| Example | 10 | 0.7 | 970 | 28 | 15.0 | 0.7 | 1.1 | 0.3 |
| Example | 11 | 0.6 | 1050 | 37 | 15.0 | 0.7 | 1.1 | 0.3 |
| Example | 12 | 0.3 | 1070 | 15 | 14.7 | 0.3 | 1.1 | 0.1 |
| Example | 13 | 0.6 | 1070 | 36 | 15.0 | 0.6 | 1.1 | 0.3 |
| Example | 14 | 0.4 | 1010 | 13 | 15.0 | 0.3 | 1.1 | 0.1 |
| Example | 15 | 0.3 | 1000 | 11 | 15.6 | 0.4 | 1.1 | 0.1 |
| Example | 16 | 0.4 | 1000 | 9 | 14.9 | 0.3 | 1.1 | 0.1 |
| Example | 17 | 0.4 | 1010 | 5 | 15.0 | 0.4 | 1.1 | 0.1 |
| Example | 18 | 0.3 | 1050 | 9 | 14.7 | 0.4 | 1.2 | 0.1 |
| Example | 19 | 0.3 | 1050 | 11 | 14.8 | 0.3 | 1.2 | 0.1 |
| Example | 20 | 0.7 | 1050 | 30 | 15.5 | 0.7 | 1.2 | 0.3 |
| Example | 21 | 0.6 | 820 | 27 | 14.0 | 0.6 | 1.2 | 0.3 |
| Comparative example | 22 | 0.6 | 750 | 23 | 8.8 | 0.2 | 1.2 | 0.3 |
| Example | 23 | 0.3 | 1100 | 13 | 13.1 | 0.2 | 1.2 | 0.1 |

TABLE 7

| Remarks | No. | Si* | K' | K'/Si* | Total area ratio of tempered martensite and bainite (%) | Average of number density of precipitates ($10^{10}$ Numbers/mm$^3$) | Standard deviation of precipitates ($10^{10}$ Numbers/min$^3$) |
|---|---|---|---|---|---|---|---|
| Comparative example | 24 | 89 | 220 | 2.48 | 96 | 9.8 | 5.5 |
| Example | 25 | 89 | 243 | 2.74 | 94 | 9.7 | 4.3 |
| Example | 26 | 89 | 585 | 6.60 | 94 | 4.0 | 4.2 |
| Example | 27 | 89 | 581 | 6.56 | 94 | 9.9 | 4.1 |
| Example | 28 | 89 | 562 | 6.35 | 96 | 10.0 | 4.3 |
| Example | 29 | 171 | 525 | 3.07 | 95 | 10.2 | 2.0 |
| Example | 30 | 198 | 610 | 3.08 | 96 | 11.0 | 2.1 |
| Example | 31 | 117 | 464 | 3.96 | 95 | 10.5 | 2.0 |
| Example | 32 | 160 | 592 | 3.71 | 94 | 10.3 | 2.2 |
| Example | 33 | 147 | 511 | 3.48 | 95 | 10.3 | 2.2 |
| Example | 34 | 141 | 524 | 3.70 | 94 | 10.5 | 2.3 |
| Example | 35 | 133 | 583 | 4.39 | 95 | 20.2 | 2.8 |
| Example | 36 | 187 | 618 | 3.30 | 95 | 10.6 | 2.1 |
| Example | 37 | 153 | 475 | 3.10 | 96 | 10.1 | 2.3 |
| Example | 38 | 131 | 447 | 3.43 | 95 | 10.1 | 2.0 |
| Example | 39 | 167 | 581 | 3.47 | 96 | 10.6 | 2.5 |

TABLE 7-continued

| | | | | | | | |
|---|---|---|---|---|---|---|---|
| Example | 40 | 133 | 448 | 3.38 | 94 | 7.3 | 2.6 |
| Comparative example | 41 | 147 | 530 | 3.61 | 95 | 1.6 | 1.4 |
| Example | 42 | 147 | 523 | 3.56 | 95 | 20.1 | 2.0 |
| Example | 43 | 154 | 427 | 2.77 | 95 | 4.5 | 2.1 |

| Remarks | No. | Standard deviation of roughness (μm) | Average tensile strength TS (MPa) | TS Standard deviation (MPa) | Average total elongation EL (%) | EL standard deviation (%) | Average limit bend radius R/t | R/t standard deviation |
|---|---|---|---|---|---|---|---|---|
| Comparative example | 24 | 1.1 | 980 | 60 | 15.3 | 1.2 | 1.0 | 0.3 |
| Example | 25 | 0.7 | 980 | 35 | 15.2 | 0.7 | 1.0 | 0.3 |
| Example | 26 | 0.6 | 930 | 33 | 15.2 | 0.7 | 1.0 | 0.3 |
| Example | 27 | 0.7 | 980 | 34 | 15.2 | 0.7 | 1.0 | 0.3 |
| Example | 28 | 0.3 | 980 | 10 | 15.2 | 0.3 | 1.0 | 0.1 |
| Example | 29 | 0.2 | 1050 | 10 | 13.1 | 0.2 | 1.0 | 0.1 |
| Example | 30 | 0.3 | 1050 | 11 | 14.5 | 0.3 | 1.0 | 0.1 |
| Example | 31 | 0.2 | 1030 | 11 | 13.5 | 0.2 | 1.0 | 0.1 |
| Example | 32 | 0.3 | 1200 | 12 | 15.5 | 0.3 | 1.2 | 0.1 |
| Example | 33 | 0.3 | 850 | 8 | 18.0 | 0.3 | 1.0 | 0.1 |
| Example | 34 | 0.3 | 1000 | 10 | 17.0 | 0.3 | 1.0 | 0.1 |
| Example | 35 | 0.2 | 1190 | 11 | 17.7 | 0.3 | 1.2 | 0.1 |
| Example | 36 | 0.3 | 1120 | 12 | 17.9 | 0.3 | 1.0 | 0.1 |
| Example | 37 | 0.3 | 1210 | 11 | 14.5 | 0.2 | 1.2 | 0.1 |
| Example | 38 | 0.3 | 1150 | 11 | 14.9 | 0.2 | 1.0 | 0.1 |
| Example | 39 | 0.3 | 1200 | 12 | 14.5 | 0.2 | 1.2 | 0.1 |
| Example | 40 | 0.2 | 803 | 7 | 20.1 | 0.3 | 1.0 | 0.1 |
| Comparative example | 41 | 0.2 | 760 | 7 | 22.2 | 0.4 | 1.0 | 0.1 |
| Example | 42 | 0.3 | 1090 | 5 | 14.6 | 0.3 | 1.2 | 0.1 |
| Example | 43 | 0.6 | 845 | 35 | 10.8 | 0.4 | 1.8 | 0.3 |

In Table 6 and Table 7, values outside the scope of the invention are underlined. As shown in the tables, in the examples in which the conditions of the present invention were satisfied, the tensile strength, the total elongation, the bendability, variation in the tensile strength, and variation in the total elongation were all excellent. On the other hand, in the comparative examples in which at least one of the conditions of the present invention was not satisfied, at least one property of the tensile strength ("Average tensile strength TS" described in Table), the total elongation ("Average total elongation EL" described in Table), the bendability ("Average limit bend radius R/t" described in Table), variation in the tensile strength ("Standard deviation of TS" described in Table), and variation in the total elongation ("Standard deviation of EL" described in Table) was not sufficient.

Specifically, in Comparative Example 1 and Comparative Example 2, the standard deviation ("Standard deviation of precipitates" described in Table) of the number densities of precipitates having a diameter of 10 nm or less and including one or both of Ti and Nb measured at a sheet thickness ¼ position of a cross section parallel to a rolling direction and perpendicular to a rolled surface was large. Therefore, in the Comparative Example 1 and Comparative Example 2, the TS standard deviation and the EL standard deviation were not good. This is assumed to be because the Comparative Example 1 and Comparative Example 2 were manufactured under conditions that K'/Si* was insufficient, and the surface roughness of the steel sheets after terminate of hot rolling was not small.

In Comparative Example 3, the total area ratio of tempered martensite and bainite was insufficient, and the standard deviation of the precipitates was large. Therefore, in the Comparative Example 3, the TS standard deviation and the EL standard deviation were not good. This is assumed to be because the Comparative Example 3 was manufactured under conditions that the average cooling rate after the finish rolling was insufficient, and the unevenness of properties caused by temperature history after coiling was not suppressed.

In Comparative Example 4, the total area ratio of tempered martensite and bainite was insufficient, and the standard deviation of the precipitates was large. Therefore, in the Comparative Example 4, the TS standard deviation and the EL standard deviation were not good. This is assumed to be because the Comparative Example 4 was manufactured under conditions that the coiling temperature was too high, and formation of internal oxide on the surface of the steel sheet and increase of surface roughness were not suppressed.

In comparative Example 5, the average tensile strength TS was insufficient and the average total elongation EL was insufficient. This is assumed to be because the Comparative Example 5 was manufactured under conditions that the tempering temperature was too high.

In comparative Example 6, the average tensile strength TS was insufficient and the average total elongation EL was insufficient. This is assumed to be because the Comparative Example 6 was manufactured under conditions that the tempering time was insufficient.

In comparative Example 22, the average tensile strength TS was insufficient and the average total elongation EL was insufficient. This is assumed to be because the Comparative Example 22 was manufactured under conditions that the tempering temperature was insufficient.

In comparative Example 41, the total amount of Ti and Nb was insufficient and the average tensile strength TS was insufficient. This is assumed to be because, in the Comparative Example 41, the amount of Ti and Nb which are material of the precipitates including Ti/Nb was insufficient and the precipitation hardening was not caused.

BRIEF DESCRIPTION OF THE REFERENCE SYMBOLS

1 High strength steel sheet (steel sheet)
11 Rolled surface
12 Cross section parallel to rolling direction and perpendicular to rolled surface
121 Sheet thickness ¼ position of cross section parallel to rolling direction and perpendicular to rolled surface
RD Rolling direction
TD Thickness direction
WD Width direction

What is claimed is:

1. A high strength steel sheet comprising, as a chemical composition, by mass %:
C: 0.030% to 0.280%;
Si: 0.05% to 2.50%;
Mn: 1.00% to 4.00%;
sol. Al: 0.001% to 2.000%;
P: 0.100% or less;
S: 0.0200% or less;
N: 0.01000% or less;
O: 0.0100% or less;
Ti: 0% to 0.20%;
Nb: 0% to 0.20%;
total of Ti and Nb: 0.04% to 0.40%;
B: 0% to 0.010%;
V: 0% to 1.000%;
Cr: 0% to 1.000%;
Mo: 0% to 1.000%;
Cu: 0% to 1.000%;
Co: 0% to 1.000%;
W: 0% to 1.000%;
Ni: 0% to 1.000%;
Ca: 0% to 0.0100%;
Mg: 0% to 0.0100%;
REM: 0% to 0.0100%;
Zr: 0% to 0.0100%; and
a remainder including Fe and impurities,
wherein, in a metallographic structure, a total area ratio of tempered martensite and bainite is 80% or more,
at a sheet thickness ¼ position of a cross section parallel to a rolling direction and perpendicular to a rolled surface, a standard deviation of number densities of precipitates having a diameter of 10 nm or less and including one or both of Ti and Nb is less than $5\times10^{10}$ numbers/mm$^3$, in which the number densities are measured at 10 points every 50 mm in a width direction, and
a tensile strength is 780 MPa or more.

2. The high strength steel sheet according to claim 1, wherein a standard deviation of surface roughnesses Ra is 1.0 μm or less, in which the surface roughnesses Ra are measured in 10 positions at intervals of 50 mm in the width direction.

3. The high strength steel sheet according to claim 1, comprising, as the chemical composition, by mass %, at least one from the group of:
B: 0.001% to 0.010%;
V: 0.005% to 1.000%;
Cr: 0.005% to 1.000%;
Mo: 0.005% to 1.000%;
Cu: 0.005% to 1.000%;
Co: 0.005% to 1.000%;
W: 0.005% to 1.000%;
Ni: 0.005% to 1.000%;
Ca: 0.0003% to 0.0100%;
Mg: 0.0003% to 0.0100%;
REM: 0.0003% to 0.0100%; and
Zr: 0.0003% to 0.0100%.

4. The high strength steel sheet according to claim 1, wherein a total elongation is 10% or more, and
R/t, which is a value calculated by dividing a limit bend radius by a thickness, is 2.0 or less.

5. The high strength steel sheet according to claim 2, comprising, as the chemical composition, by mass %, at least one from the group of:
B: 0.001% to 0.010%;
V: 0.005% to 1.000%;
Cr: 0.005% to 1.000%;
Mo: 0.005% to 1.000%;
Cu: 0.005% to 1.000%;
Co: 0.005% to 1.000%;
W: 0.005% to 1.000%;
Ni: 0.005% to 1.000%;
Ca: 0.0003% to 0.0100%;
Mg: 0.0003% to 0.0100%;
REM: 0.0003% to 0.0100%; and
Zr: 0.0003% to 0.0100%.

6. The high strength steel sheet according to claim 2, wherein a total elongation is 10% or more, and
R/t, which is a value calculated by dividing a limit bend radius by a thickness, is 2.0 or less.

7. The high strength steel sheet according to claim 3, wherein a total elongation is 10% or more, and
R/t, which is a value calculated by dividing a limit bend radius by a thickness, is 2.0 or less.

8. The high strength steel sheet according to claim 5, wherein a total elongation is 10% or more, and
R/t, which is a value calculated by dividing a limit bend radius by a thickness, is 2.0 or less.

* * * * *